US007232248B2

(12) United States Patent
Sung et al.

(10) Patent No.: US 7,232,248 B2
(45) Date of Patent: Jun. 19, 2007

(54) BACKLIGHT UNIT AND DISPLAY DEVICE

(75) Inventors: Kuang-Tao Sung, Fongyuan (TW); Cheng-Mou Lee, Taoyuan (TW)

(73) Assignee: AU Optronics Corp., Hsinchu (TW)

( * ) Notice: Subject to any disclaimer, the term of this patent is extended or adjusted under 35 U.S.C. 154(b) by 219 days.

(21) Appl. No.: 10/858,246

(22) Filed: Jun. 1, 2004

(65) Prior Publication Data

US 2005/0195589 A1 Sep. 8, 2005

(30) Foreign Application Priority Data

Mar. 4, 2004 (TW) ..... 93105680 A

(51) Int. Cl.
*F21V 7/04* (2006.01)

(52) U.S. Cl. ..... 362/613; 349/68; 345/1.1; 362/24; 362/88; 362/251

(58) Field of Classification Search ..... 362/612–614, 362/251, 261, 24, 88; 349/68, 61, 65, 69; 455/566; 345/1.1
See application file for complete search history.

(56) References Cited

U.S. PATENT DOCUMENTS 1,786,768 A * 12/1930 Moorhouse ..... 362/23
6,499,852 B1 * 12/2002 Kino et al. ..... 362/23
6,714,128 B2 * 3/2004 Abbe et al. ..... 340/468
6,853,418 B2 * 2/2005 Suzuki et al. ..... 349/113
6,944,481 B2 * 9/2005 Hama et al. ..... 455/566
6,981,791 B2 * 1/2006 Higashiyama ..... 362/600
2001/0011029 A1 * 8/2001 Iwabuchi et al. ..... 455/566
2003/0067587 A1 * 4/2003 Yamasaki et al. ..... 353/30
2003/0234897 A1 * 12/2003 Ozawa ..... 349/65
2004/0095522 A1 * 5/2004 Lee et al. ..... 349/61
2005/0073627 A1 4/2005 Akiyama
2005/0141065 A1 6/2005 Masamoto

OTHER PUBLICATIONS

Japan Office Action mailed Feb. 1, 2007.

* cited by examiner

*Primary Examiner*—Renee Luebke
*Assistant Examiner*—Gunyoung T. Lee
(74) *Attorney, Agent, or Firm*—Thomas, Kayden, Horstemeyer & Risley

(57) ABSTRACT

A backlight unit. The backlight unit is employed in a display device having a main screen and a sub screen. The backlight unit comprises a first light-emitting unit and a second light-emitting unit. When the display device uses the sub screen, the first light-emitting unit provides a first light to the sub screen. When the display device uses the main screen, the first and the second light-emitting units respectively emit a second light and a third light, and a first aggregate light comprising the second light and the third light is provided to the main screen.

6 Claims, 4 Drawing Sheets

BACKLIGHT UNIT AND DISPLAY DEVICE

BACKGROUND OF THE INVENTION

1. Field of the Invention

The present invention relates to a backlight unit, and in particular to a backlight unit for a display device having a main screen and a sub screen. The backlight unit drives light-emitting diodes corresponding to the sub screen utilizing an independent circuit, thereby reducing current consumption.

2. Description of the Related Art

Liquid crystal displays (LCDs) are employed applied in variety of electronic devices, such as mobile phones, digital cameras, personal digital assistants, and other devices used in environments providing varying degrees of brightness. In order to provide adequate display brightness, backlight sources are provided located in an rear of the LCD panel.

Currently, many mobile phones have hinged displays with a main screen and a sub screen disposed on eacg side thereof. The main screen is disposed on the inner side of the hinged display and displays a main menu and related information. The sub-screen is disposed on the outer side of the hinged display and displays general information, such as data, time and so on. Generally, the main screen and the sub screen respectively have a light source and a light guide configured in a backlight unit within a liquid crystal module of the mobile phone. The described mobile phone suffer from the disadvantages of large volume and excessive power consumption.

To solve the described problems, light-emitting diodes (LEDs) coupled in series and one light guide are employed in a backlight unit for displaying images in the main screen and the sub screen. FIG. 1 shows a schematic diagram of the backlight unit with serial light-emitting diodes. A main screen MD1 and a sub screen SD1 are relatively disposed. LEDs 1A to 1D correspond to the main screen MD1 and LEDs 1B and 1C further correspond to the sub screen SD1. When the main screen MD1 or the sub screen SD1 is used, all LEDs 1A to 1D are driven to emit light. That is, the LEDs corresponding to the main screen MD1 and the LEDs corresponding to the sub screen SD1 are all lit.

Practically, when the mobile phone is in standby mode, the hinged cover is closed such that the sub screen SD1 on the outer side of the flip cover can be viewed. Meanwhile, the LEDs 1B and 1C corresponding to both screens MD1 and SD1, and LEDs 1A and 1D corresponding to the main screen MD1 are all driven to emit light. The lit LEDs 1A and 1D cause unnecessary power consumption and reduced battery life.

Additionally, LEDs 2A to 2D coupled in parallel are applied in a backlight unit, as shown in FIG. 2. Because the impedances of LEDs 2A to 2D are different, brightness thereof is unequal, resulting in uneven brightness of the backlight unit and poor display quality.

SUMMARY OF THE INVENTION

Accordingly, one object, of the present invention is to provide a backlight unit for application in a display device comprising a main screen and a sub screen. The backlight unit respectively drives LEDs corresponding to the main screen and LEDs corresponding to the sub screen via two independent circuits.

According to the object described above, an embodiment of the present invention provides a backlight unit for a display device having a main screen and a sub screen. The backlight unit comprises a first light-emitting unit and a second light-emitting unit. When the display device uses the sub screen, the first light-emitting unit provides a first light to the sub screen. When the display device uses the main screen, the first and the second light-emitting units respectively emit a second light and a third light, and a first aggregate light including the second light and the third light is provided to the main screen.

The present invention further provides a display device. The display device comprises a main screen, a sub screen, a first light-emitting unit, a second light-emitting unit, and a control unit. The sub screen is disposed opposite to the main screen. When the display device uses the sub screen, the control unit drives the first light-emitting unit to provide a first light to the sub screen. When the display device uses the main screen, the control unit drives the first and second light-emitting units to respectively emit a second light and a third light, and a first aggregate light comprising the second light with the third light is provided to the main screen.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
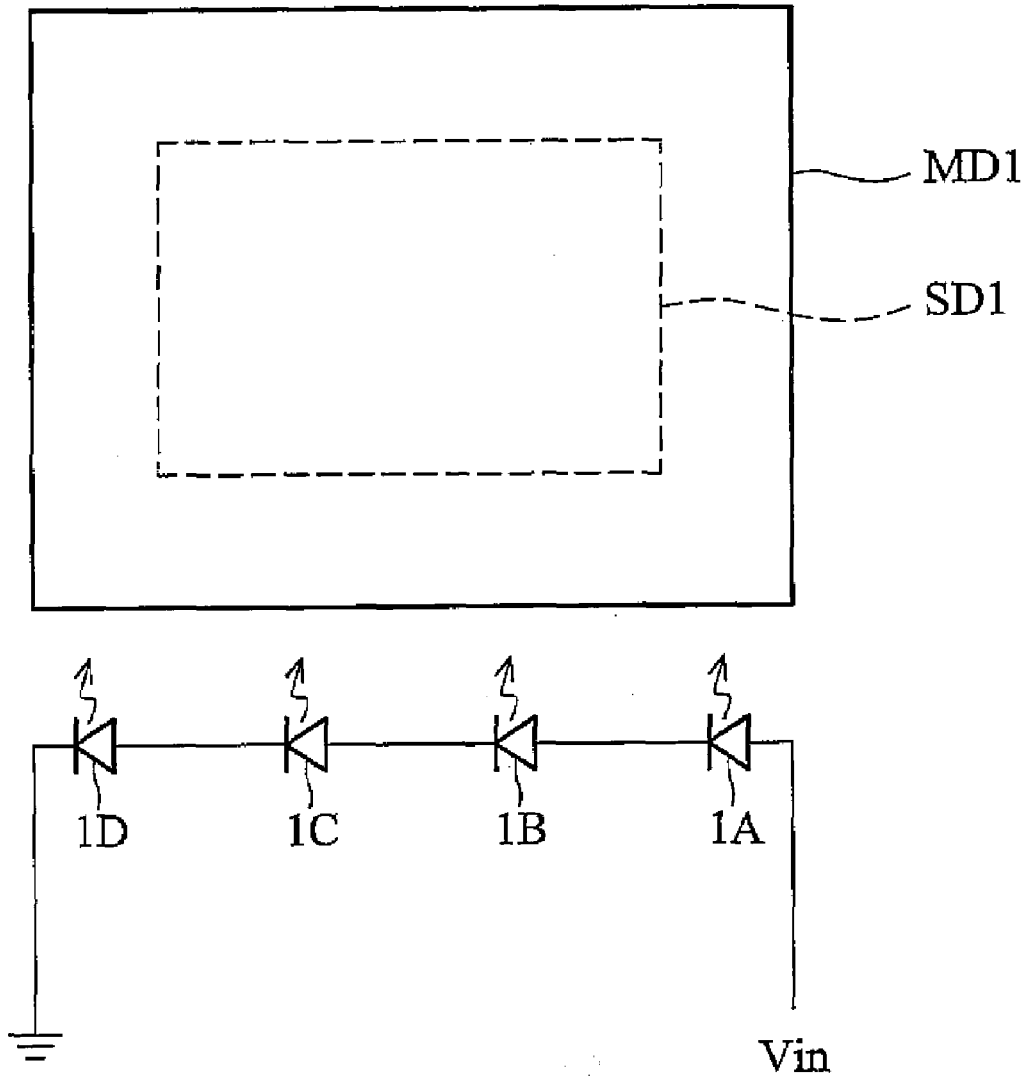
FIG. 1 ( Prior Art )
FIG. 1 shows a schematic diagram of the backlight unit with serial light-emitting diodes in a conventional mobile phone with a hinged display.
Figure 2:
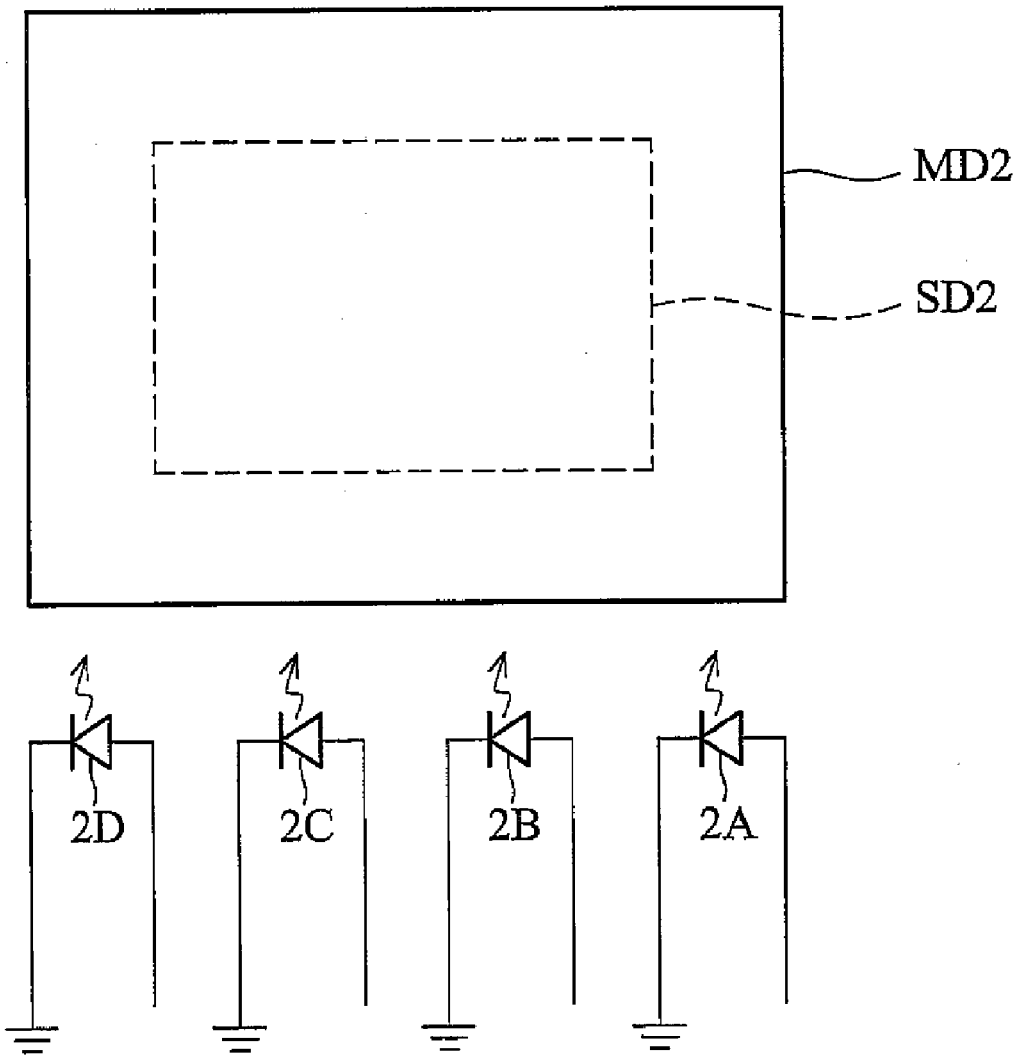
FIG. 2 ( Prior Art )
FIG. 2 shows a schematic diagram of the backlight unit with parallel light-emitting diodes in a conventional mobile phone with a hinged display.
Figure 3:
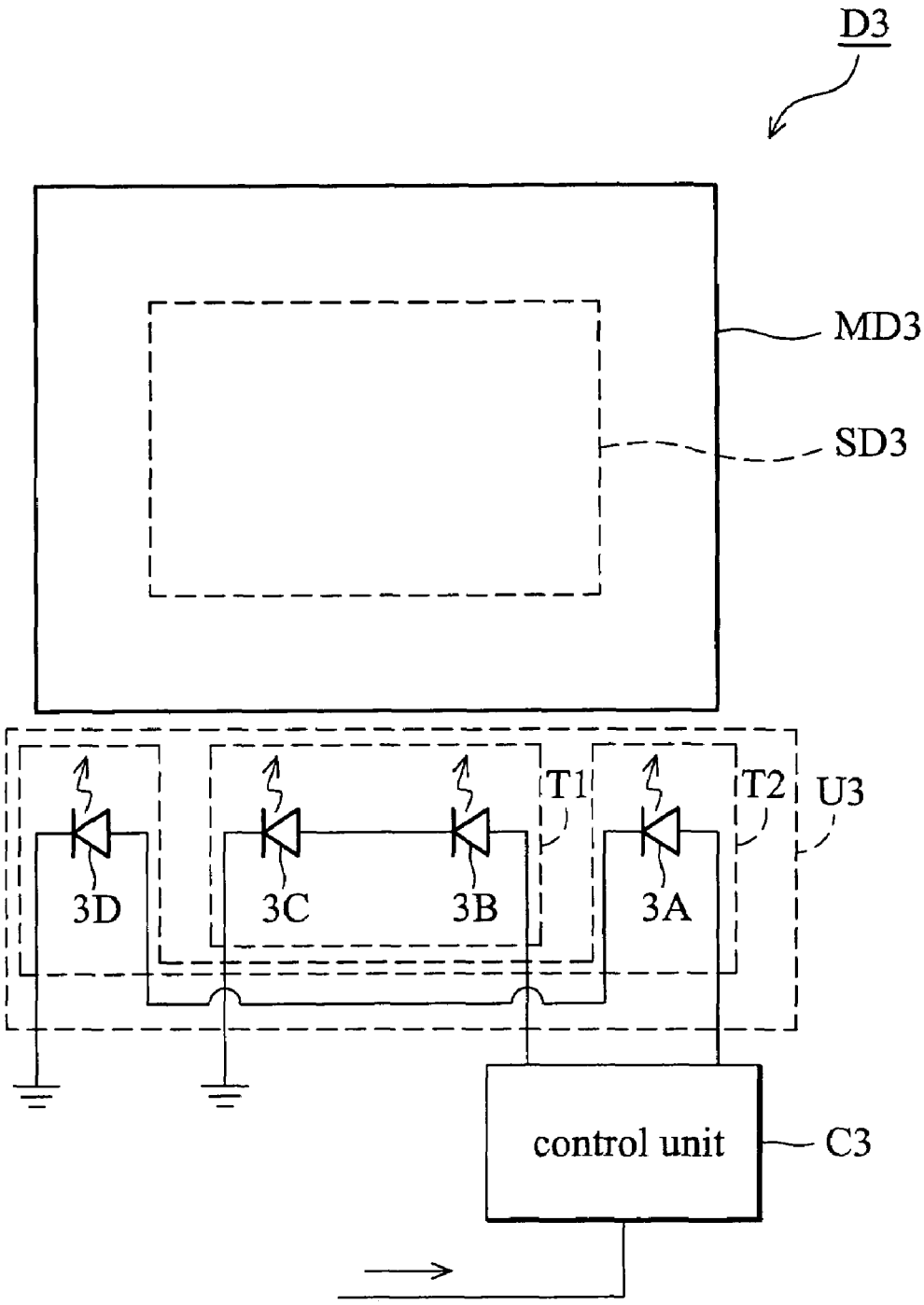
FIG. 3 shows a schematic diagram of a LCD of the present invention.
Figure 4A:
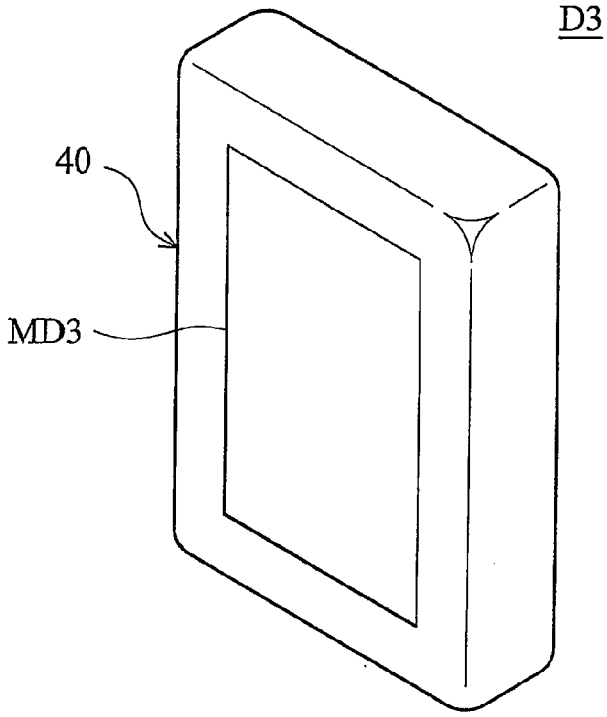
FIGS. 4*a* and 4*b* respectively show an inner side and an outer side of the LCD of FIG. 3.
Figure 4B:
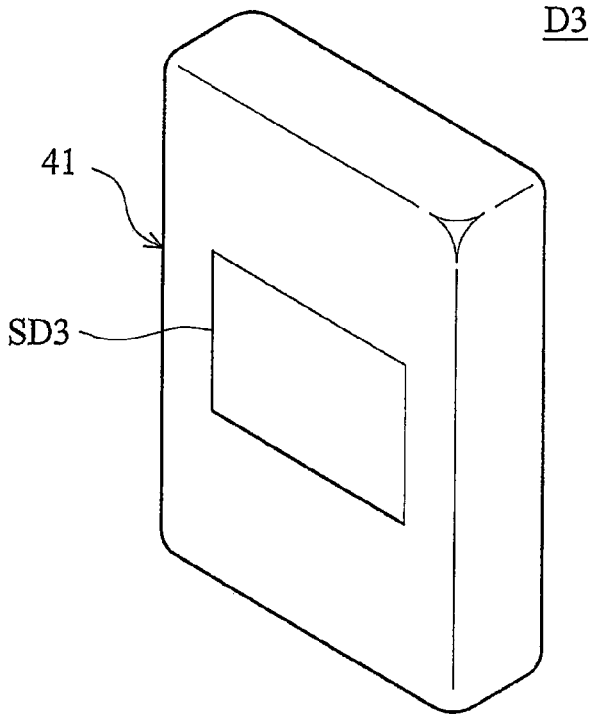

FIG. 3 shows a schematic diagram of a LCD of the present invention. The LCD D3 has a single light guide and two screens comprising, a main screen MD3 and a sub screen SD3. Referring to FIGS. 4*a* and 4*b*, the main screen MD3 and the sub screen SD3 are disposed respectively on the inner side 40 and the outer side 41 of the LCD D3. In FIG. 3, the sub screen SD3, disposed opposite to the main screen SD3, is represented by dotted lines. A backlight unit U3 comprises a first light-emitting unit T1 and a second light-emitting unit T2. The first light-emitting unit T1 has two LEDs 3B and 3C coupled in series, wherein a cathode of the LED 3B is coupled to the anode of the LED 3C, and a cathode of the LED 3C is coupled to a ground. Similarly, the second light-emitting unit T2 has two LEDs 3A and 3D coupled in series, wherein a cathode of the LED 3A is coupled to the anode of the LED 3D, and a cathode of the LED 3D is coupled to the ground. The LEDs 3A to 3D correspond to the main screen MD3, wherein the LEDs 3B and 3C also correspond to the sub screen SD3. Two output terminals of a control unit C3 are respectively coupled to the cathodes of the LEDs 3A and 3B to control the first and the second light-emitting units T1 and T2.

When receiving a first signal indicating that the sub screen SD3 is assigned to display images, the control unit C3 provides a first voltage to the anode of the LED 3B, such that the first light-emitting unit T1 emits light to the sub screen SD3. When receiving a second signal indicating that the main screen MD3 is assigned to display images, the control unit C3 provides the first voltage and a second voltage respectively to the anodes of the LEDs 3B and 3A, such that the first and second light-emitting units T1 and T2 emit light to the main screen MD3 simultaneously.

Moreover, when receiving the first signal, the control unit C3 further provides the first voltage and a third voltage respectively to the anodes of the LEDs 3B and 3A. The third voltage is less than the first voltage, so brightness of the first light-emitting unit T2 is lower than that of the second light-emitting unit T1.

In the present invention, the LED circuit corresponding to the sub screen SD3 and other LED circuits are controlled independently. When only the sub screen SD3 is assigned to display images, the corresponding LEDs 3B and 3C are lit while the other LEDs either remain unlit or emit light with low brightness. Therefore, less voltage is provided to the LEDs unrelated to the sub screen SD3, reducing power consumption and prolonging standby duration.

In the present invention, the number of serial LEDs of the first and second light-emitting units T1 and T2 can be determined according to system requirements, without limitation.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display device comprising:

a main screen disposed on an inner side of the display device;

a sub screen disposed on an outer side of the display device and opposite to the main screen;

a first light-emitting unit;

a second light-emitting unit; and a control unit controlling the first and the second light-emitting units, wherein the first light-emitting unit couples between a first output terminal of the control unit and a reference terminal having a reference voltage level, and the second light-emitting unit couples between a second output terminal of the control unit and the reference terminal, wherein the current path between the first output terminal and the reference terminal is electrically independent of the current path between the second output terminal and the reference terminal;

wherein the control unit drives the first light-emitting unit to emit a first light to the sub screen when the display device uses the sub screen; and wherein when the display device uses the main screen, the control unit drives the first and the second light-emitting units to respectively emit the first light and a second light to the main screen.

2. The display device as claimed in claim 1, wherein the first and the second light-emitting units are respectively driven by a signal with a first voltage and a signal with a second voltage, the first light-emitting unit is coupled to the signal with the first voltage to emit the first light when the display device uses the sub screen, and the first and the second light-emitting units, coupled to the signal with the first voltage and the signal with the second voltage respectively, emit the first light and the second light when the display device uses the main screen.

3. The display device as claimed in claim 1, wherein the first light-emitting unit comprises a plurality of main light-emitting diodes coupled in series and the second light-emitting unit comprises a plurality of sub light-emitting diodes coupled in series.

4. The display device as claimed in claim 1, wherein the first and the second light-emitting units respectively emit the first light and the second light when the display device uses the sub screen, and brightness of the second light when the display device uses the sub screen is lower than brightness of the second light when the display device uses the main screen.

5. The display device as claimed in claim 1, wherein the first light-emitting unit corresponds to the sub screen and the main screen, and the second light-emitting unit corresponds to the main screen.

6. The display device as claimed in claim 2, wherein the signal with the first voltage is provided to the first light-emitting unit when the control unit receives a first signal indicating that the display device is using the sub screen, the signal with the first voltage and the signal with the second voltage are respectively provided to the first and the second light-emitting units when the control unit receives a second signal indicating that the display device is using the main screen.

* * * * *